US010293407B2

(12) United States Patent
Nakaseko et al.

(10) Patent No.: US 10,293,407 B2
(45) Date of Patent: May 21, 2019

(54) METHOD OF PRODUCING ATOMIZED METAL POWDER

(71) Applicant: JFE Steel Corporation, Tokyo (JP)

(72) Inventors: Makoto Nakaseko, Chiba (JP); Naomichi Nakamura, Chiba (JP); Yukiko Ozaki, Itoshima (JP)

(73) Assignee: JFE Steel Corporation (JP)

( * ) Notice: Subject to any disclaimer, the term of this patent is extended or adjusted under 35 U.S.C. 154(b) by 295 days.

(21) Appl. No.: 15/129,839

(22) PCT Filed: Mar. 13, 2015

(86) PCT No.: PCT/JP2015/001407
§ 371 (c)(1),
(2) Date: Sep. 28, 2016

(87) PCT Pub. No.: WO2015/151420
PCT Pub. Date: Oct. 8, 2015

(65) Prior Publication Data

US 2017/0144227 A1 May 25, 2017

(30) Foreign Application Priority Data

Mar. 31, 2014 (JP) ..... 2014-072786

(51) Int. Cl.
*B22F 9/08* (2006.01)
*C22C 45/02* (2006.01)
(Continued)

(52) U.S. Cl.
CPC ..... *B22F 9/082* (2013.01); *B22F 9/002* (2013.01); *C22C 33/0264* (2013.01);
(Continued)

(58) Field of Classification Search
None
See application file for complete search history.

(56) References Cited

U.S. PATENT DOCUMENTS 4,647,305 A * 3/1987 Kumai ..... B22F 9/008 264/12
9,991,036 B2 * 6/2018 Kudo ..... H01F 1/15308
(Continued)

FOREIGN PATENT DOCUMENTS

CN 103111625 5/2013
CN 203495240 3/2014
(Continued)

OTHER PUBLICATIONS

English translation of JP 2004-349364 (published Dec. 9, 2004) from Espacenet.*
(Continued)

*Primary Examiner* — George Wyszomierski
(74) *Attorney, Agent, or Firm* — DLA Piper LLP (US)

(57) ABSTRACT

A water-atomized metal powder is produced by dividing a molten metal stream into a metal powder by making injection water having a liquid temperature of 10° C. or less and an injection pressure of 5 MPa or more impinge on the molten metal stream and cooling the metal powder. Cooling with injection water having a liquid temperature of 10° C. or less and an injection pressure of 5 MPa or more enables can be performed not in the film boiling region but in the transition boiling region from the beginning of cooling. A gas-atomized metal powder may also be produced by dividing a molten metal stream into a metal powder by making an inert gas impinge on the molten metal stream and cooling the metal powder with injection water having a liquid temperature of 10° C. or less and an injection pressure of 5 MPa or more.

6 Claims, 4 Drawing Sheets

(51) Int. Cl.
*B22F 9/00* (2006.01)
*C22C 33/02* (2006.01)

(52) U.S. Cl.
CPC ..... *C22C 45/02* (2013.01); *B22F 2009/0824* (2013.01); *B22F 2009/0828* (2013.01); *B22F 2009/0848* (2013.01); *B22F 2009/0872* (2013.01); *B22F 2009/0888* (2013.01); *B22F 2301/35* (2013.01); *B22F 2998/10* (2013.01); *B22F 2999/00* (2013.01)

(56) References Cited

U.S. PATENT DOCUMENTS

| | | | | |
|---|---|---|---|---|
| 2005/0236071 | A1* | 10/2005 | Koshiba | H01F 1/15308 148/304 |
| 2006/0090595 | A1* | 5/2006 | Furuya | B01J 2/06 75/338 |
| 2007/0246131 | A1* | 10/2007 | Watanabe | B22F 9/002 148/403 |
| 2013/0180360 | A1* | 7/2013 | Kim | B22F 9/082 75/337 |
| 2018/0071826 | A1* | 3/2018 | Nakaseko | B22F 9/02 |

FOREIGN PATENT DOCUMENTS

| | | | |
|---|---|---|---|
| JP | 5-45026 | | 6/1993 |
| JP | 07-107167 | B2 | 11/1995 |
| JP | 3461344 | B2 | 10/2003 |
| JP | 2004-349364 | A | 12/2004 |
| JP | 3932573 | B2 | 3/2007 |
| JP | 2007-291454 | A | 11/2007 |
| JP | 2010-150587 | A | 7/2010 |
| JP | 4784990 | B2 | 7/2011 |
| JP | 4793872 | B2 | 8/2011 |
| KR | 10-2007-0087463 | | 8/2007 |

OTHER PUBLICATIONS

Japanese Office Action dated Apr. 26, 2016, of corresponding Japanese Application No. 2015-539900, along with a Concise Statement of Relevance of Office Action in English.

Korean Application dated Feb. 21, 2018, of corresponding Korean Application No. 10-2016-7027009, along with a Concise Statement of Relevance of Office Action in English.

Chinese Office Action dated Apr. 27, 2017, of corresponding Chinese Application No. 201580016835.9, along with a Search Report in English.

Korean Office Action dated Aug. 11, 2017, of corresponding Korean Application No. 10-2016-7027009 along with a Concise Statement of Relevance of Office Action in English.

* cited by examiner

METHOD OF PRODUCING ATOMIZED METAL POWDER

TECHNICAL FIELD

This disclosure relates to a method of producing a metal powder with an atomizing device (hereinafter, such a metal powder is referred to as "atomized metal powder") and particularly relates to a method of increasing the rate at which the metal powder is cooled subsequent to atomization.

BACKGROUND

One of the methods of producing a metal powder known in the art is an atomization process. There are two types of atomization processes: a water atomization process in which a high-pressure water jet is made to impinge on a molten metal stream to produce a metal powder; and a gas atomization process in which, instead of a water jet, an inert gas is made to impinge on a molten metal stream.

In a water atomization process, a water-atomized metal powder is produced by dividing a molten metal stream into a powdered metal (metal powder) with a water jet ejected through nozzles and cooling the powdered metal (metal powder) with the water jet. On the other hand, in a gas atomization process, an atomized metal powder is produced by dividing a molten metal stream into a powdered metal (metal powder) with an inert gas ejected through nozzles and, generally, cooling the powdered metal (metal powder) by dropping the powdered metal into a tank containing water or a drum containing swirling water disposed below the atomizing device.

Recently, a reduction in the iron losses of motor cores for electric vehicles, hybrid vehicles and the like has been anticipated from the viewpoint of energy conservation. While motor cores are produced using multilayers of electromagnetic steel sheets, attention is being focused on motor cores formed of a metal powder (electromagnetic iron powder), which allows a high degree of flexibility in designing the shapes of the motor cores. To reduce the iron losses of such motor cores, it is necessary to reduce the iron loss of a metal powder constituting the motor cores. To reduce the iron loss of the metal powder, it is considered to be effective to change the metal powder into an amorphous state. To produce an amorphous metal powder by an atomization process, however, it is necessary to cool the metal powder that is in a high-temperature condition including a molten state at a considerably high cooling rate to prevent crystallization of the metal powder.

Accordingly, there have been proposed several methods of rapidly cooling a metal powder.

For example, Japanese Unexamined Patent Application Publication No. 2010-150587 describes a method of producing a metal powder in which scattered molten metal particles are cooled and solidified to form a metal powder. The rate at which the molten metal particles are cooled until they solidify is $10^5$ K/s or more. In the technique described in JP '587, the above cooling rate is achieved by bringing the scattered molten metal particles into contact with a stream of a cooling liquid generated by passing the cooling liquid along the inner wall of a cylindrical body in a spiral. It is described that the flow rate of the stream of the cooling liquid, which is generated by passing the cooling liquid in a spiral, is preferably 5 to 100 m/s.

Japanese Examined Patent Application Publication No. 7-107167 describes a method of producing a rapidly solidified metal powder. In the technique described in JP '167, a cooling liquid is fed from the outer periphery of the top end of a cylindrical portion of a cooling container having a cylindrical inner periphery in the circumferential direction to flow downward along the inner periphery of the cylindrical portion in a spiral. The cooling liquid forms a laminar, spiral cooling-liquid layer having a cavity at the center due to the centrifugal force generated by the spiral stream of the cooling liquid. A molten metal is fed to the inner periphery of the spiral cooling-liquid layer and rapidly solidified. This enables a high-quality, rapidly solidified powder to be produced with a high cooling efficiency.

Japanese Patent No. 3932573 describes an apparatus that produces a metal powder by a gas atomization process and includes a gas jet nozzle through which a gas jet is made to impinge on a molten metal stream to divide the molten metal stream into molten metal droplets and a cooling cylinder including a layer of a cooling liquid that flows downward along the inner periphery of the cylinder in a spiral. In the technique described in JP '573, the molten metal is divided in two stages by using the gas jet nozzle and the spiral cooling-liquid layer. This enables a fine, rapidly solidified metal powder to be produced.

Japanese Patent No. 3461344 describes a method of producing amorphous metal fine particles. In that method, a molten metal is fed into a liquid coolant such that a steam film that covers the molten metal is formed in the coolant, and the steam film is broken to bring the molten metal into direct contact with the coolant. This induces boiling caused due to natural nucleation. While the molten metal is divided into particles with the power of the pressure wave resulting from the boiling, the molten metal particles are rapidly cooled and changed into an amorphous state. Thus, amorphous metal fine particles are produced. It is described that the steam film that covers the molten metal can be broken by controlling the temperature of the molten metal fed into the coolant such that, when the molten metal is brought into direct contact with the coolant, the temperature of the molten metal at the interface between the molten metal and the coolant is equal to or lower than the minimum film boiling temperature and equal to or higher than the spontaneous nucleation temperature or by using ultrasound.

Japanese Patent No. 4793872 describes a method of producing fine particles. In that method, a molten material is fed into a liquid coolant in the form of droplets or a jet stream while the temperature of the molten material is such that the molten material has a temperature equal to or more than the spontaneous nucleation temperature of the liquid coolant and is in a molten state when contacting the liquid coolant. Furthermore, the difference in relative velocity between the molten material and a stream of the liquid coolant at the time the molten material is fed into the stream of the liquid coolant is controlled to 10 m/s or more. This causes the steam film formed around the molten material to be forcibly broken and boiling to occur due to spontaneous nucleation. Thus, the molten material is formed into fine particles, and the fine particles are cooled and solidified. That method is said to enable materials that have been considered to be difficult to be formed into fine particles and changed into an amorphous state to be formed into fine particles and changed into an amorphous state.

Japanese Patent No. 4784990 describes a method of producing a functional member, the method including a step in which a raw material prepared by adding a functional additive to a base material is molten and fed into a liquid coolant to cause steam explosion, which enables the molten raw material to be formed into fine particles, and the fine particles are cooled and solidified at a controlled cooling rate to form homogeneous functional fine polycrystalline or amorphous particles free from segregation and a step in which the functional fine particles and fine particles of the base material used as raw materials, are solidified to form a functional member.

In general, it is difficult to bring the surface of a molten metal into perfect contact with cooling water when the hot molten metal is brought into contact with the cooling water to rapidly cool the molten metal. This is because the cooling water vaporizes upon coming into contact with the surface (surface to be cooled) of the hot molten metal and forms a steam film between the surface to be cooled of the molten metal and the cooling water, that is, the cooling water is brought into the film boiling state. The presence of the steam film inhibits facilitation of cooling of the molten metal.

In the techniques described in JP '587, JP '167 and JP '573, attempts have been made to remove a steam film formed around metal particles by feeding a divided molten metal into a layer of a cooling liquid formed of a spiral stream of a cooling liquid. However, if the temperature of the metal particles is high, film boiling is likely to occur in the cooling-liquid layer. In addition, since the metal particles fed into the cooling-liquid layer move together with the cooling-liquid layer, the difference in relative velocity between the metal particles and the cooling-liquid layer is small. This makes it difficult to prevent a film boiling state.

In the techniques described in JP '344, JP '872 and JP '990, a steam film covering a molten metal is broken with the power of steam explosion by which the film boiling state is serially into the nucleate boiling state to produce amorphous metal fine particles. Removing a steam film formed during film boiling with the power of steam explosion is an effective approach. However, to cause steam explosion by making the film boiling state into the nucleate boiling state, as is clear from the boiling curve illustrated in FIG. 4, it is necessary to at first at least reduce the surface temperature of the metal particles to the MHF (minimum heat flux) point or less. The graph shown in FIG. 4 is referred to as "boiling curve" that schematically illustrates the relationship between the cooling capacity of a water coolant (cooling water) and the surface temperature of a material to be cooled. As illustrated in FIG. 4, if the surface temperature of metal particles is high, cooling of the metal particles to the MHF temperature is performed in the film-boiling region. The intensity of cooling of the metal particles performed in the film-boiling region is low because of the presence of steam films interposed between the surfaces to be cooled of the metal particles and the cooling water. Accordingly, if the metal particles are cooled from a temperature equal to or more than the MHF temperature to produce an amorphous metal powder, there is a problem that the cooling rate of producing amorphous is insufficient.

It could therefore be helpful to provide a method of producing an atomized metal powder that enables rapid cooling of the metal powder to be achieved and an amorphous metal powder to be produced.

SUMMARY

We thus provide:

(1) A method of producing an atomized metal powder, the method including dividing a molten metal stream into a metal powder by making a fluid impinge on the molten metal stream; and cooling the metal powder, the fluid being injection water having a liquid temperature of 10° C. or less and an injection pressure of 5 MPa or more, the fluid being used for dividing the molten metal stream and cooling the metal powder.

(2) A method of producing an atomized metal powder, the method including dividing a molten metal stream into a metal powder by making a fluid impinge on the molten metal stream; and cooling the metal powder, the fluid being an inert gas, the fluid being used for dividing the molten metal stream, the cooling of the metal powder being performed with injection water having a liquid temperature of 10° C. or less and an injection pressure of 5 MPa or more.

(3) The method of producing an atomized metal powder described in (2), wherein the impinging of the injection water is performed after a temperature of the metal powder has reached 1000° C. or less.

(4) The method of producing an atomized metal powder described in any one of (1) to (3), wherein the molten metal stream includes a Fe—B alloy or a Fe—Si—B alloy, and the atomized metal powder is an amorphous metal powder.

It becomes possible to rapidly cool a metal powder at a cooling rate of $10^5$ K/s or more by using a simple method and readily produce an amorphous atomized metal powder. This makes it possible to readily produce a metal powder for dust cores having a low iron loss at a low cost and offers remarkable industrial advantages. Our methods also offer another advantage when it becomes easy to produce a low-iron-loss dust core having a complex shape.

REFERENCE SIGNS LIST

1 MOLTEN METAL
2 MELTING FURNACE
3 TUNDISH
4 MOLTEN-METAL-GUIDE NOZZLE
5 NOZZLE HEADER
6 NOZZLES (WATER INJECTION NOZZLES)
7 FLUID (INJECTION WATER)
8 MOLTEN METAL STREAM
**8*a*** METAL POWDER
9 CHAMBER
10 HOPPER
11 INERT GAS VALVE
12 OVERFLOW VALVE
13 METAL POWDER COLLECTION VALVE
14 WATER-ATOMIZED METAL POWDER PRODUCTION DEVICE
15 COOLING-WATER TANK
16 CHILLER (LOW-TEMPERATURE COOLING WATER PRODUCTION DEVICE)
17 HIGH-PRESSURE PUMP
18 COOLING-WATER PIPE
19 GAS-ATOMIZED METAL POWDER PRODUCTION DEVICE
21 NOZZLE HEADER (GAS NOZZLE HEADER)
22 GAS NOZZLES
24 HEADER VALVE

25 COOLING-WATER INJECTION NOZZLES
25*a* INJECTION WATER
26 COOLING-WATER VALVE
27 GAS BOMB FOR GAS ATOMIZATION
28 HIGH-PRESSURE GAS PIPE

DETAILED DESCRIPTION

We conducted extensive studies of various factors that may affect the MHF point in water-injection cooling and, as a result, found that the temperature and injection pressure of cooling water greatly affect the MHF point. Our results are described below.

As a material, a SUS304 stainless steel sheet (size: 20 mm thick×150 mm wide×150 mm long) was used. A thermocouple was inserted into the material from the rear surface such that the temperature of the material at a position (at the center in the width and longitudinal directions) 1 mm below the front surface can be measured. The material was charged into a heating furnace purged with an oxygen-free atmosphere and heated to 1200° C. or more. Immediately after the heated material was removed from the heating furnace, cooling water was made to impinge on the material through cooling nozzles for atomization at various water temperatures and various injection pressures. The changes in the temperature of the material at a position 1 mm below the front surface were measured. The cooling capacities of the cooling water during cooling of the material were estimated by a calculation based on the measured temperature data. A boiling curve was prepared on the basis of the estimated cooling capacities. The MHF point was determined by considering the point at which the cooling capacity was sharply increased as a point at which a transition was made from the film boiling state to the transition boiling state.

Figure 1:
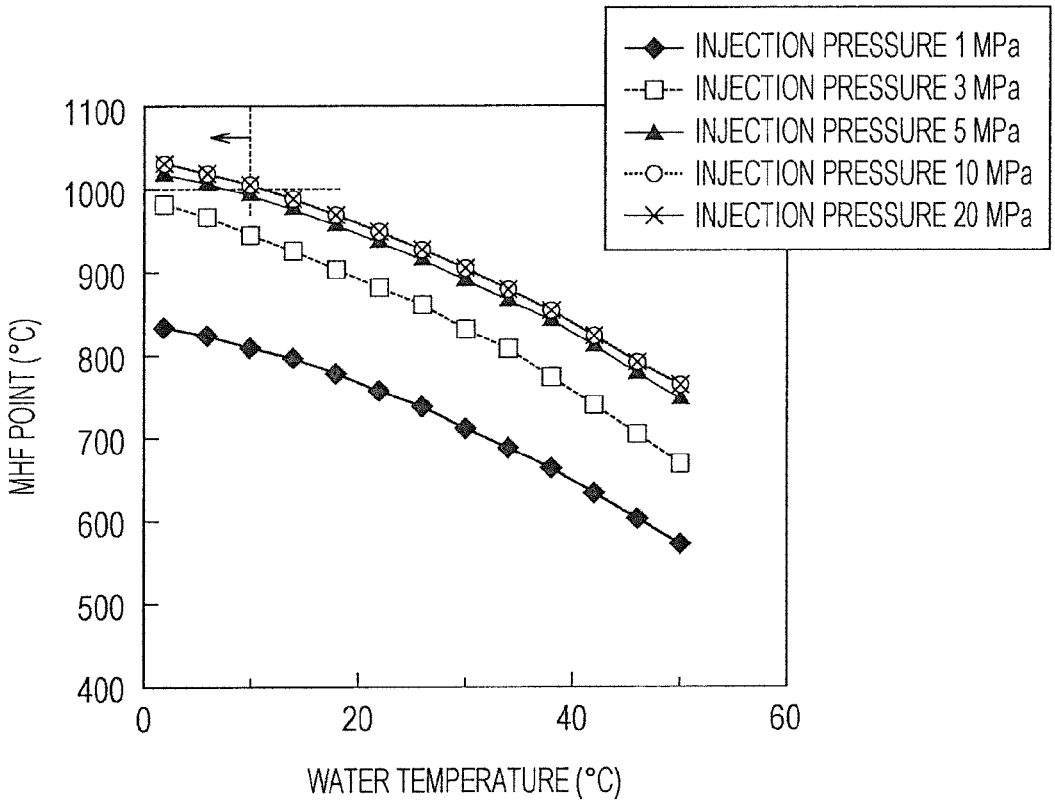
FIG. 1 is a graph illustrating the impact of the water temperature and injection pressure of cooling water on the MHF point.

FIG. 1 summarizes the results.

As illustrated in FIG. 1, when cooling water having a water temperature of 30° C., which has been commonly used in an ordinary water atomization process, is made to impinge on a material to be cooled at an injection pressure of 1 MPa, the MHF point is about 700° C. while the cooling water is made to impinge on the material to be cooled. When cooling water having a water temperature of 10° C. or less and 2° C. or more is made to impinge on a material to be cooled at an injection pressure of 5 MPa or more and 20 MPa or less, the MHF point is about 1000° C. or more while the cooling water is made to impinge on the material to be cooled. Thus, we found that reducing the temperature (water temperature) of the cooling water to 10° C. or less and increasing the injection pressure to 5 MPa or more increases the MHF point, that is, the temperature at which a transition is made from the film boiling state to the transition boiling state.

In general, a metal powder has a surface temperature of about 1000° C. to 1300° C. immediately after the metal powder has been produced by atomization of a molten metal. The temperature range in which cooling needs to be performed to prevent crystallization from occurring is from about 1000° C. to the first crystallization temperature or less. If water-injection cooling is started such that the temperature at which the metal powder starts being cooled is higher than the MHF point, cooling is performed in the film boiling region, in which the cooling capacity of the cooling water is low, at the beginning of cooling. Therefore, when water-injection cooling is performed such that the MHF point is equal to or higher than the temperature range in which cooling needs to be performed, it become possible to start cooling the metal powder at least from the transition boiling region, in which cooling of the metal powder is facilitated compared with the film boiling region. As a result, the rate at which the metal powder is cooled can be markedly increased. We found if the metal power is cooled in the above-described manner with a high cooling capacity, a rapid cooling in the crystallization temperature range, which is essential to produce an amorphous metal powder, can be readily achieved.

At first, a metal material used as a raw material is melted to form a molten metal. Examples of the metal material that can be used as a raw material include pure metals, alloys, and pig iron, which have been commonly used in powder form. Specific examples thereof include pure iron, iron-base alloys such as low-alloy steel and stainless steel, nonferrous metals such as Ni and Cr, nonferrous alloys, and amorphous alloys such as Fe—B alloys, Fe—Si—B alloys, and Fe—Ni—B alloys. Needless to say, the above alloys may contain impurities other than the above-described elements.

It is not necessary to limit a method of melting the metal material. Common melting means such as an electric furnace, a vacuum melting furnace, and a high-frequency melting furnace may be used.

Figure 2:
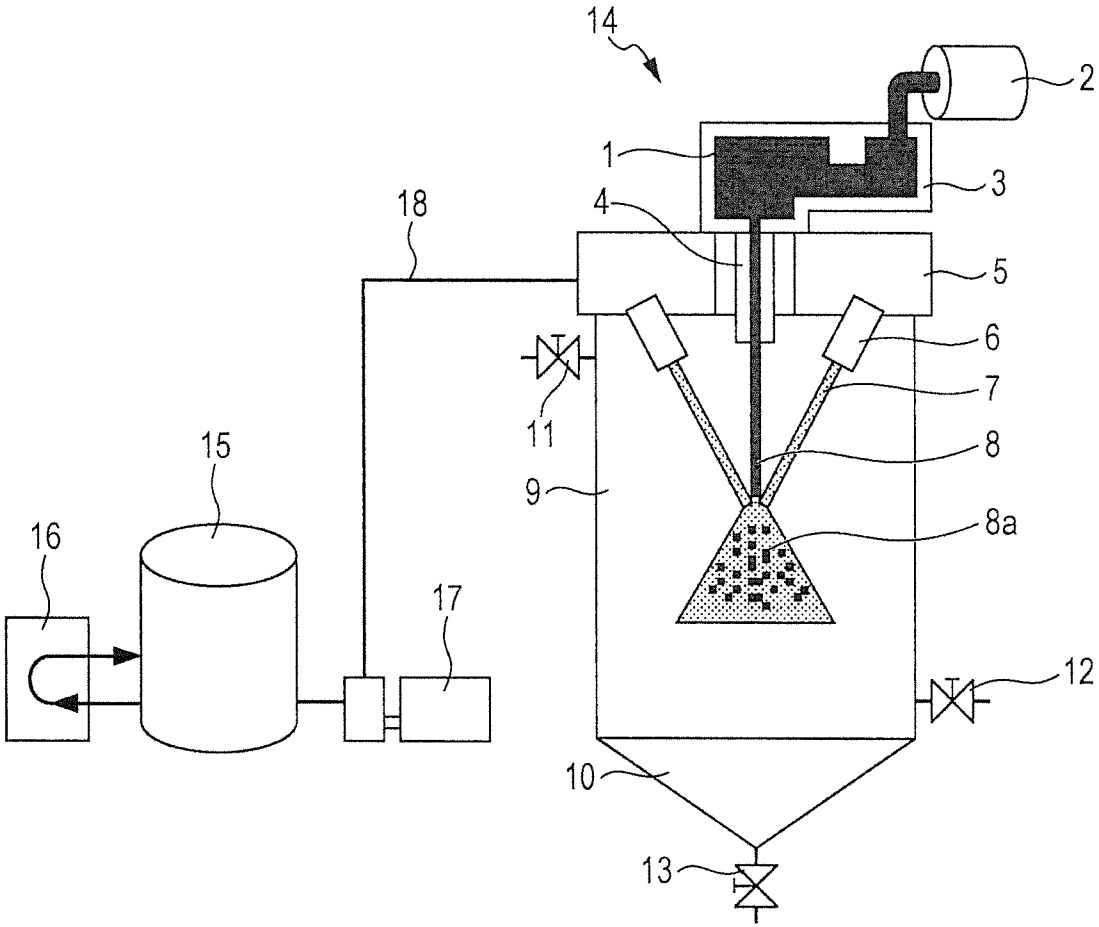
FIG. 2 is a schematic diagram illustrating the structure of a water-atomized metal powder production device.

The molten metal is transferred from the melting furnace to a container such as a tundish and formed into an atomized metal powder inside an atomized metal powder production device. FIG. 2 illustrates a preferable example of a water-atomized metal powder production device.

An example in which a water atomization process is employed is described below with reference to FIG. 2.

A molten metal 1 is passed downward from a container such as a tundish 3 into a chamber 9 through a molten-metal-guide nozzle 4 in the form of a molten metal stream 8. The inside of the chamber 9 is purged with an inert gas (e.g., a nitrogen gas or an argon gas) atmosphere by opening an inert gas valve 11.

A fluid 7 is made to impinge on the molten metal stream 8 through nozzles 6 disposed on a nozzle header 5 to divide the molten metal stream 8 into a metal powder 8*a*. When a water atomization process is used, injection water (water jet) is used as a fluid 7.

Injection water (water jet) is used as a fluid 7. The injection water (water jet) used has a liquid temperature of 10° C. or less and an injection pressure of 5 MPa or more.

If the liquid temperature (water temperature) of the injection water is higher than 10° C., it becomes impossible to perform water-injection cooling such that the desired MHF point of about 1000° C. or more is achieved and, as a result, the desired cooling rate may fail to be achieved. Accordingly, the liquid temperature (water temperature) of the injection water is limited to be 10° C. or less and is preferably set to 7° C. or less. The term "desired cooling rate" used herein refers to the minimum cooling rate at which an amorphous metal powder can be produced, that is, a cooling rate of about $10^5$ to $10^6$ K/s on average at which the temperature is reduced from the temperature at which solidification has terminated to the first crystallization temperature (e.g., about 400° C. to 600° C.) on average.

If the injection pressure of the injection water (water jet) is less than 5 MPa, it becomes impossible to perform water-injection cooling such that the MHF point is equal to or higher than the desired temperature even when the water temperature of the cooling water is 10° C. or less and, as a result, the desired rapid cooling treatment (desired cooling rate) may fail to be achieved. Accordingly, the injection pressure of the injection water is limited to 5 MPa or more. The injection pressure of the injection water is preferably 10 MPa or less because the MHF point stops increasing when the injection pressure is higher than 10 MPa.

In the production of a metal powder in which water atomization is used, injection water having a water temperature and an injection pressure controlled to be specific values as described above is made to impinge on a molten metal stream to divide the molten metal stream into a metal powder and cool and solidify the metal powder (including a metal powder in a molten state) at the same time.

The cooling water used as injection water is preferably stored in a cooling-water tank 15 (heat-insulated structure) disposed outside the water-atomized metal powder production device 14 after it has been cooled to a low temperature with a heat exchanger such as a chiller 16 capable of cooling the cooling water to a low temperature. Means for feeding ice from an ice-making machine into the tank may optionally be provided because it is difficult to make cooling water having a temperature of less than 3° C. to 4° C. with a common cooling-water-making machine due to freezing of the inside of the heat exchanger. It is preferable to make cooling water having a temperature of more than 0° C. since cooling water having a temperature of 0° C. or less is likely to freeze. Needless to say that the cooling-water tank 15 is provided with a high-pressure pump 17 that increases the pressure of the cooling water and feeds the cooling water to the nozzle header 5 and a pipe 18 through which the cooling water is fed from the high-pressure pump to the nozzle header 5.

Figure 3:
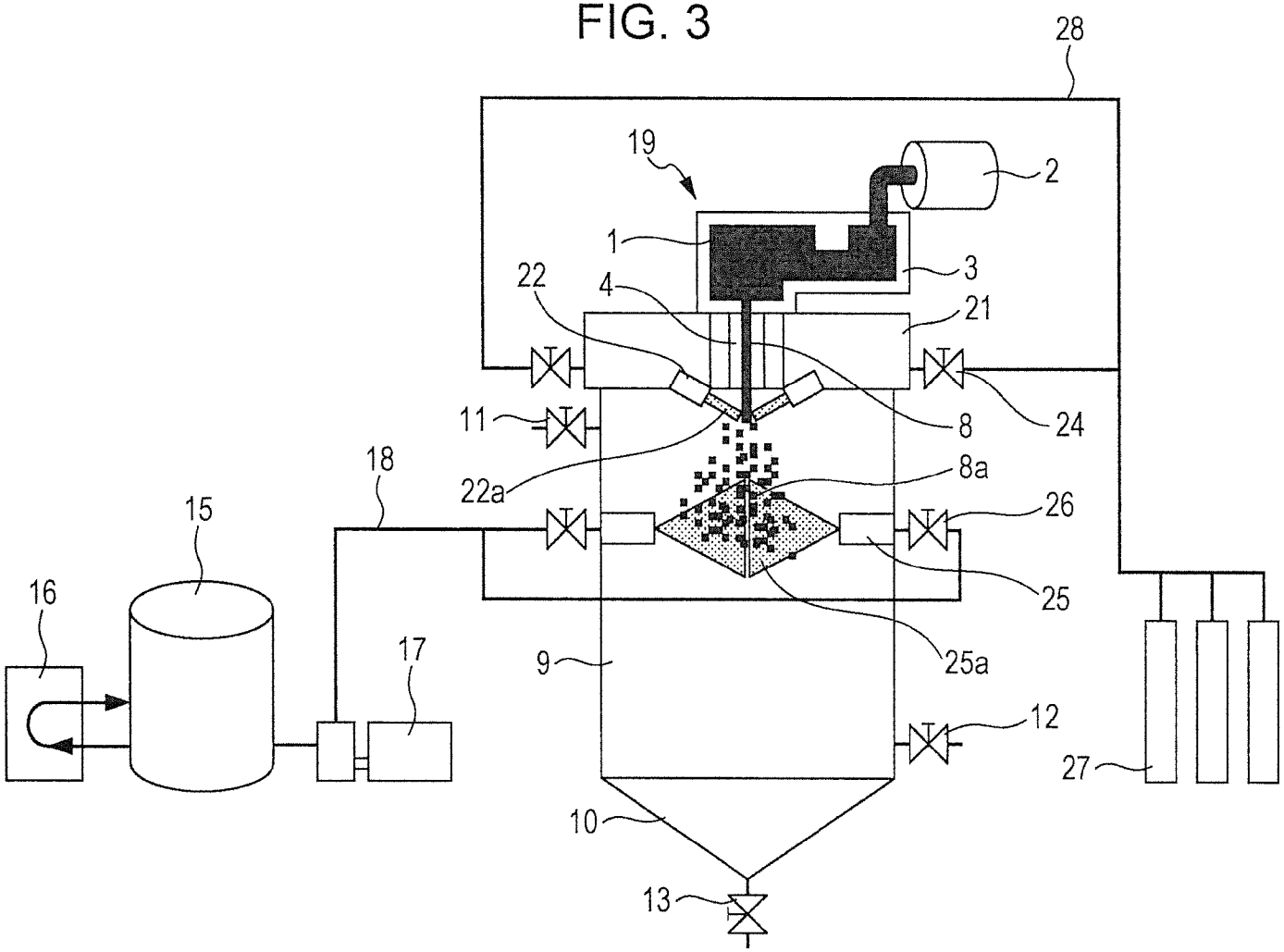
FIG. 3 is a schematic diagram illustrating the structure of a gas-atomized metal powder production device.
Figure 4:
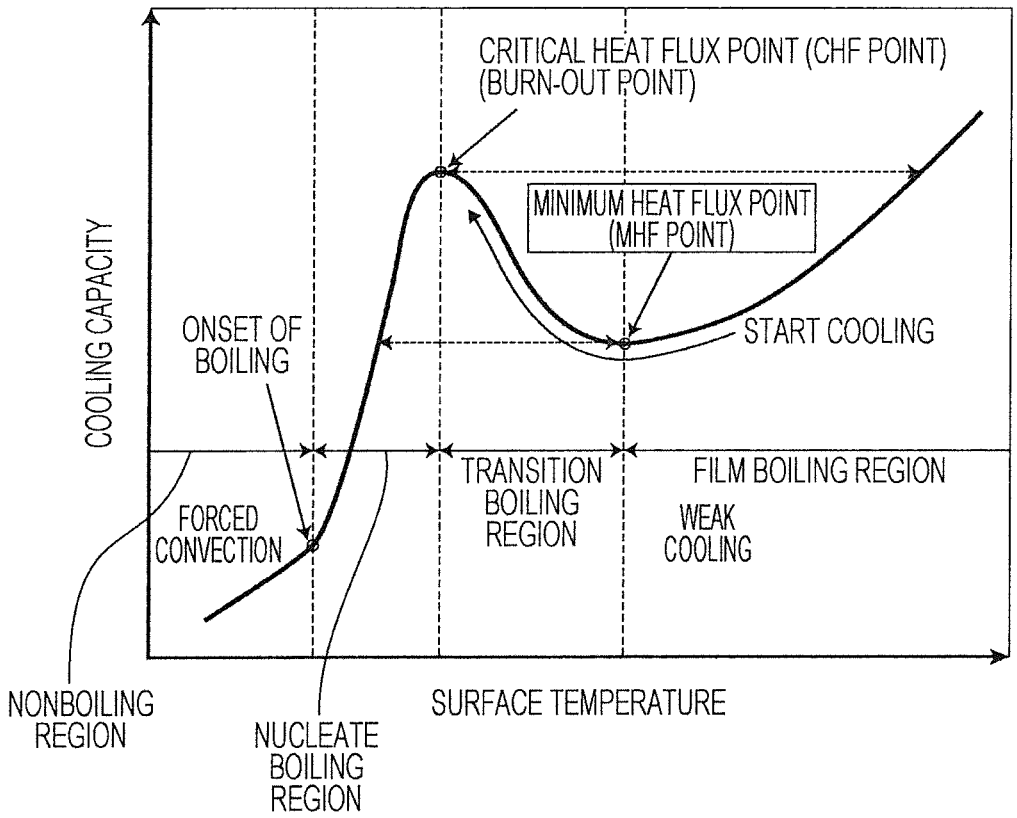
FIG. 4 is a schematic diagram illustrating a boiling curve.

Division of the molten metal stream may be performed by a gas atomization process in which an inert gas 22*a* is used as a fluid 7. The resulting metal powder is further cooled with injection water. That is, in the production of a metal powder in which a gas atomization process is used, an inert gas is made to impinge on a molten metal stream to divide the molten metal stream into a metal powder, and the metal powder (including a metal powder in a molten state) is cooled with injection water having an injection pressure: 5 MPa or more and a water temperature of 10° C. or less. FIG. 3 illustrates a preferable example of a gas-atomized metal powder production device.

An example in which a gas atomization process is used is described below with reference to FIG. 3.

A molten metal 1 is transferred from a melting furnace 2 to a container such as a tundish 3 and passed downward from the container into a chamber 9 through a molten-metal-guide nozzle 4 of a gas-atomized metal powder production device 19 in the form of a molten metal stream 8. The inside of the chamber 9 is purged with an inert gas atmosphere by opening an inert gas valve 11.

An inert gas 22*a* is made to impinge on the molten metal stream 8 through gas injection nozzles 22 disposed in a gas nozzle header 21 to divide the molten metal stream 8 into a metal powder 8*a*. Injection water 25*a* is made to impinge on the metal powder 8*a* at the position at which the temperature of the metal powder 8*a* is about 1000° C., at which the temperature range in which cooling needs to be performed is preferably achieved to cool the metal powder 8*a*. The injection water 25*a* has an injection pressure of 5 MPa or more and a water temperature of 10° C. or less.

Performing cooling with injection water having an injection pressure of 5 MPa or more and a water temperature of 10° C. or less increases the MHF point to about 1000° C. Accordingly, a metal powder that preferably has a temperature of about 1000° C. or less is cooled with injection water having an injection pressure of 5 MPa or more and a water temperature of 10° C. or less. This enables cooling to be performed in the transition boiling region from the beginning of cooling and facilitates cooling the metal powder. As a result, the desired cooling rate may be readily achieved. The temperature of the metal powder can be controlled by changing the distance between the gas atomization point and the position at which the injection water is made to impinge on the metal powder.

When the temperature of the metal powder 8*a* is as high as more than 1000° C. at the beginning of cooling with the injection water, cooling is performed in the film boiling state even when the water temperature of the injection water is less than 5° C. The cooling capacity of injection water is low compared with cooling performed in the transition boiling state, which occurs when cooling is started at 1000° C. or less, but high compared with an ordinary cooling treatment performed in the film boiling state at an injection pressure of less than 5 MPa and a water temperature of 10° C. or more. In addition, the amount of time during which cooling is performed in the film boiling state can be reduced. Furthermore, reducing the water temperature of the injection water and increasing the injection pressure of the injection water increases the MHF point and enhances the amorphous nature of the metal powder to be produced. For example, setting the water temperature of the injection water to 5° C. or less and the injection pressure of the injection water to 10 MPa or more increases the MHF point to about 1030° C. This enables a metal powder having a large particle diameter to be changed into an amorphous state.

As described above, a molten metal stream is divided by a gas atomization process and subsequently cooled with injection water having an injection pressure of 5 MPa or more and a water temperature of 10° C. or less. Performing water-injection cooling under the above-described conditions when the temperature of the metal powder is the MHF point or less further increases the cooling rate.

Similarly to the above-described case where a water atomization process used, the cooling water used as injection water is preferably stored in the cooling-water tank 15 (heat-insulated structure) disposed outside the gas-atomized metal powder production device 19 after it has been cooled to a low temperature with a heat exchanger such as a chiller 16 capable of cooling the cooling water to a low temperature. Means for feeding ice from an ice-making machine into the tank may optionally be provided. Needless to say that the gas nozzle header 21 connects to a gas bomb 27 with a pipe 28 and that the cooling-water tank 15 is provided with, similarly to the water-atomized metal powder production device, a high-pressure pump 17 that increases the pressure of the cooling water and feeds the cooling water to cooling-water injection nozzles 25 and a pipe 18 through which the cooling water is fed from the high-pressure pump to the cooling-water injection nozzles 25.

To change a metal powder into an amorphous powder, it is necessary to rapidly cool the metal powder in the crystallization temperature range. The critical cooling rate required to produce an amorphous powder varies depending on the type of the alloy system. For example, the critical cooling rate of Fe—B alloys ($Fe_{83}B_{17}$) is $1.0\times10^6$ K/s and the critical cooling rate of Fe—Si—B alloys ($Fe_{79}Si_{10}B_{11}$) is $1.8\times10^5$ K/s (The Japan Society of Mechanical Engineers: Boiling Heat Transfer and Cooling, p. 208, 1989, Japan Industrial Publishing Co., Ltd.). The critical cooling rates required to produce an amorphous powder of typical amorphous alloys such as Fe-base alloys and Ni-base alloys are about $10^5$ to $10^6$ K/s. The method of producing a metal powder in which performing cooling in the film boiling region is prevented from the beginning of cooling and cooling is performed in the transition boiling region or the nucleate boiling region as in our method, enables the above-described cooling rate to be achieved.

EXAMPLES

Example 1

A metal powder was produced using a water-atomized metal powder production device illustrated in FIG. 2.

A raw material having a composition containing (with the balance being inevitable impurities), by at %, 79% Fe-10% Si-11% B ($Fe_{79}Si_{10}B_{11}$) was prepared. The raw material was melted in a melting furnace 2 at about 1550° C. Thus, about 50 kgf of a molten metal was prepared. The molten metal was slowly cooled to 1350° C. in the melting furnace 2 and subsequently charged into a tundish 3. The inside of a chamber 9 was purged with a nitrogen gas atmosphere by opening an inert gas valve 11. Before the molten metal was charged into the tundish 3, a high-pressure pump 17 was brought into operation and cooling water stored in a cooling-water tank 15 (volume: 10 $m^3$) was fed to a nozzle header 5. Thus, injection water (fluid) 7 started being ejected through water injection nozzles 6. The position at which the molten metal stream 8 was brought into contact with the injection water (fluid) 7 was set at a position 200 mm below the molten-metal-guide nozzle 4.

The molten metal 1 charged in the tundish 3 was passed downward into the chamber 9 through the molten-metal-guide nozzle 4 in the form of a molten metal stream 8. The molten metal stream 8 was contacted with injection water (fluids) 7 having various water temperatures and injection pressures as described in Table 1, and was divided into a metal powder and cooled by being mixed with the cooling water. The metal powder was collected through a collection port including a metal powder collection valve 13.

After dust other than the metal powder particles had been removed from the metal powders, a sample was taken from each of the metal powders and subjected to an X-ray diffraction measurement. The crystallization ratio of each sample was determined on the basis of the ratio between the integrated intensities of diffracted X-rays. The amorphous ratio (=1−crystallization ratio) of each sample was calculated by subtracting the crystallization ratio from 1. Table 1 summarizes the results. A sample having an amorphous ratio of 90% or more was evaluated as "passed." Although some of the metal powders contained compounds as impurities, the contents of the compounds contained as impurities in such metal powders were less than 1% by mass.

TABLE 1

| | | Division and cooling | | | | |
|---|---|---|---|---|---|---|
| | | | Fluid injection conditions | | Amorphous ratio | |
| Powder No. | Atomization method | Type of injection fluid | Injection pressure (MPa) | Water temperature (° C.) | ○: 90% or more x: Less than 90% | Remarks |
| A1 | Water atomization | Water | 5 | 30 | x 74% | Comparative Example |
| A2 | | Water | 5 | 8 | ○ 92% | Our Example |
| A3 | | Water | 1 | 8 | x 82% | Comparative Example |

The metal powder prepared in our Example had a crystallization ratio of less than 10%. This confirms that the most part of the metal powder was amorphous. On the other hand, the metal powders prepared in the Comparative Examples which did not fall within our range each had a crystallization ratio of 10% or more. This confirms that the metal powders were not amorphous. Since we believe that the critical cooling rate required to change a metal powder having the same alloy composition ($Fe_{79}Si_{10}B_{11}$) as that of the metal powder used in Example 1 into an amorphous metal powder is $1.8\times10^5$ K/s, we believe that a cooling rate of $1.8\times10^5$ K/s or more was achieved in our Example.

Example 2

A metal powder was prepared using a gas-atomized metal powder production device illustrated in FIG. 3.

A raw material having a composition containing (with the balance being inevitable impurities), by at %, 79% Fe-10% Si-11% B ($Fe_{79}Si_{10}B_{11}$) was prepared. The raw material was melted in a melting furnace 2 at about 1550° C. Thus, about 10 kgf of a molten metal was prepared. The molten metal was slowly cooled to 1400° C. in the melting furnace and subsequently charged into a tundish 3. The inside of a chamber 9 was purged with a nitrogen gas atmosphere by opening an inert gas valve 11. Before the molten metal was charged into the tundish 3, a high-pressure pump 17 was brought into operation and cooling water stored in a cooling-water tank 15 (volume: 10 $m^3$) fed to water injection nozzles 25. Thus, injection water (fluid) 25*a* started being ejected through the water injection nozzles 25.

The molten metal 1 charged in the tundish 3 was passed downward into the chamber 9 through the molten-metal-guide nozzle 4 in the form of a molten metal stream 8, which was brought into contact with an argon gas (fluid) 22*a* ejected through gas nozzles 22 at an injection pressure of 5 MPa to be divided into a metal powder 8*a*. The metal powder was cooled and solidified due to thermal radiation and the action of the atmosphere gas. The metal powder was subsequently cooled with each of injection waters having various injection pressures and water temperatures as described in Table 2 at the time the metal powder had been cooled to about 1000° C., that is, at the position 350 mm (or, 250 mm) below the gas atomization point (the point at which the molten metal stream 8 was brought into contact with the argon gas 22*a*). The cooled metal powder was collected through a collection port including a metal powder collection valve 13.

After dust other than the metal powder particles had been removed from the metal powders, a sample was taken from each of the metal powders and subjected to an X-ray diffraction measurement. The crystallization ratio of each sample was determined on the basis of the ratio between the integrated intensities of diffracted X-rays. The amorphous ratio (=1−crystallization ratio) of each sample was calculated by subtracting the crystallization ratio from 1. Table 2 summarizes the results. A sample having an amorphous ratio of 90% or more was evaluated as "passed." Although some of the metal powders contained compounds as impurities, the contents of the compounds contained as impurities in such metal powders were less than 1% by mass.

TABLE 2

| Powder No. | Atomization method | Division: Type of injection fluid | Division: Injection condition: Injection pressure (MPa) | Cooling: Type of injection fluid | Cooling: Fluid injection conditions: Injection pressure (MPa) | Cooling: Fluid injection conditions: Water temperature (° C.) | Cooling: Average powder temperature at the beginning of cooling (° C.) | Cooling: Water injection position* (mm) | Amorphous ratio ○: 90% or more x: Less than 90% | Remarks |
|---|---|---|---|---|---|---|---|---|---|---|
| B1 | Gas atomization | Gas | 5 | Water | 5 | 30 | 997 | 350 | x 77% | Comparative Example |
| B2 | | | | Water | 5 | 8 | 995 | 350 | ○ 92% | Our Example |
| B3 | | | | Water | 1 | 8 | 996 | 350 | x 73% | Comparative Example |
| B4 | | | | Water | 20 | 4 | 1046 | 250 | ○ 94% | Our Example |

*Distance from the gas atomization point

The metal powders prepared in our Examples had a crystallization ratio of less than 10%. This confirms that most parts of the metal powders were amorphous. We also confirmed that most of the powder No. B4, which had been cooled with injection water that fell within our range, was amorphous although the average temperature of the powder at the beginning of cooling was 1046° C. This is because, that the MHF point was increased to about 1050° C. by setting the injection pressure of the injection water to 20 MPa and the water temperature of the injection water to 4° C.

On the other hand, the metal powders prepared in the Comparative Examples which did not fall within our range each had a crystallization ratio of 10% or more. This confirms that the metal powders were not amorphous. Since we believe that the critical cooling rate required to change a metal powder having the same alloy composition ($Fe_{79}Si_{10}B_{11}$) as that of the metal powder used in Example 2 into an amorphous metal powder is $1.8\times10^5$ K/s, we believe that a cooling rate of $1.8\times10^5$ K/s or more was achieved in our Examples.

Example 3

A metal powder was prepared using a gas-atomized metal powder production device illustrated in FIG. 3.

A raw material having a composition containing (with the balance being inevitable impurities), by at %, 83% Fe-17% B ($Fe_{83}B_{17}$) was prepared. The raw material was melted in a melting furnace 2 at about 1550° C. Thus, about 10 kgf of a molten metal was prepared. The molten metal was slowly cooled to 1500° C. in the melting furnace and subsequently charged into a tundish 3. The inside of a chamber 9 was purged with a nitrogen gas atmosphere by opening an inert gas valve 11. Before the molten metal was charged into the tundish 3, a high-pressure pump 17 was brought into operation and cooling water stored in a cooling-water tank 15 (volume: 10 $m^3$) fed to water injection nozzles 25. Thus, injection water (fluid) 25*a* began being ejected through the water injection nozzles 25.

The molten metal 1 charged in the tundish 3 was passed downward into the chamber 9 through the molten-metal-guide nozzle 4 in the form of a molten metal stream 8, which was brought into contact with an argon gas (fluid) 22*a* ejected through gas nozzles 22 at an injection pressure of 5 MPa to be divided into a metal powder 8*a*. The metal powder was cooled and solidified due to thermal radiation and the action of the atmosphere gas. The metal powder was subsequently cooled with injection water having a specific injection pressure and a specific water temperature described in Table 3 at the time the metal powder had been cooled to about 1000° C., that is, at the position 450 mm (or, 250 mm) below the gas atomization point. The metal powder was collected through the metal powder collection valve 13. After dust other than the metal powder particles had been removed from the metal powders, a sample was taken from each of the metal powders and subjected to an X-ray diffraction measurement. The crystallization ratio of each sample was determined on the basis of the ratio between the integrated intensities of diffracted X-rays. The amorphous ratio (=1−crystallization ratio) of each sample was calculated by subtracting the crystallization ratio from 1. Table 3 summarizes the results. A sample having an amorphous ratio of 90% or more was evaluated as passed. Although some of the metal powders contained compounds as impurities, the contents of the compounds contained as impurities in such metal powders were less than 1% by mass.

TABLE 3

| Powder No. | Atomization method | Division: Type of injection fluid | Division: Injection condition: Injection Pressure (MPa) | Cooling: Type of injection fluid | Cooling: Fluid injection conditions: Injection pressure (MPa) | Cooling: Fluid injection conditions: Water temperature (° C.) | Cooling: Average powder temperature at the beginning of cooling (° C.) | Cooling: Water injection position* (mm) | Amorphous ratio ○: 90% or more x: Less than 90% | Remarks |
|---|---|---|---|---|---|---|---|---|---|---|
| C1 | Gas atomization | Gas | 5 | Water | 5 | 30 | 995 | 450 | x 87% | Comparative Example |
| C2 | | | | Water | 5 | 8 | 994 | 450 | ○ 93% | Our Example |

TABLE 3-continued

| | | Division | | Cooling | | | | | | |
|---|---|---|---|---|---|---|---|---|---|---|
| | | | Injection condition | | Fluid injection conditions | | Average powder | Water | | |
| Powder No. | Atomization method | Type of injection fluid | Injection Pressure (MPa) | Type of injection fluid | Injection pressure (MPa) | Water temperature (° C.) | temperature at the beginning of cooling (° C.) | injection position* (mm) | Amorphous ratio ○: 90% or more x: Less than 90% | Remarks |
| C3 | | | | Water | 1 | 8 | 995 | 450 | x 78% | Comparative Example |
| C4 | | | | Water | 20 | 4 | 1047 | 250 | ○ 95% | Our Example |

*Distance from the gas atomization point

The metal powders prepared in our Examples had a crystallization ratio of less than 10%. This confirms that the most parts of the metal powders were amorphous. We confirmed that most of the powder No. C4, which had been cooled with injection water that fell within our range, was amorphous although the average temperature of the powder at the beginning of cooling was 1047° C. This is because, while the metal powder was cooled, the MHF point was increased to about 1050° C. by setting the injection pressure of the injection water to 20 MPa and the water temperature of the injection water to 4° C.

On the other hand, the metal powders prepared in the Comparative Examples which did not fall within our range each had a crystallization ratio of 10% or more. This confirms that the metal powders were not amorphous. Since we believe that the critical cooling rate required to change a metal powder having the same alloy composition ($Fe_{83}B_{17}$) as that of the metal powder used in Example 3 into an amorphous metal powder is $1.0\times10^6$ K/s, we believe that a cooling rate of $1.0\times10^6$ K/s or more was achieved in our Examples.

The invention claimed is:

1. A method of producing an atomized metal powder comprising dividing a molten metal stream into a metal powder by making a fluid impinge on the molten metal stream; and cooling the metal powder, the fluid being injection water having a temperature of 10° C. or less and an injection pressure of 5 MPa to 20 MPa, the fluid being used to divide the molten metal stream and cool the metal powder.

2. The method according to claim 1, wherein the molten metal stream includes a Fe—B alloy or a Fe—Si—B alloy, and the atomized metal powder is an amorphous metal powder.

3. A method of producing an atomized metal powder comprising dividing a molten metal stream into a metal powder by making a fluid impinge on the molten metal stream; and cooling the metal powder, the fluid being an inert gas, the fluid being used to divide the molten metal stream, cooling of the metal powder being performed with injection water having a temperature of 10° C. or less and an injection pressure of 5 MPa or more.

4. The method according to claim 3, wherein the impinging the injection water is performed after a temperature of the metal powder has reached 1000° C. or less.

5. The method according to claim 4, wherein the molten metal stream includes a Fe—B alloy or a Fe—Si—B alloy, and the atomized metal powder is an amorphous metal powder.

6. The method according to claim 3, wherein the molten metal stream includes a Fe—B alloy or a Fe—Si—B alloy, and the atomized metal powder is an amorphous metal powder.

* * * * *